US008372223B1

(12) United States Patent
Hordos

(10) Patent No.: US 8,372,223 B1
(45) Date of Patent: Feb. 12, 2013

(54) GAS GENERANT WITH AUTOIGNITION FUNCTION

(75) Inventor: Deborah L. Hordos, Troy, MI (US)

(73) Assignee: TK Holdings, Inc., Armada, MI (US)

( * ) Notice: Subject to any disclaimer, the term of this patent is extended or adjusted under 35 U.S.C. 154(b) by 267 days.

(21) Appl. No.: 12/456,557

(22) Filed: Jun. 18, 2009

Related U.S. Application Data

(60) Provisional application No. 61/132,557, filed on Jun. 18, 2008, provisional application No. 61/132,556, filed on Jun. 18, 2008.

(51) Int. Cl.

| | |
|---|---|
| ***C06B 31/00*** | (2006.01) |
| ***C06B 31/02*** | (2006.01) |
| ***C06B 31/12*** | (2006.01) |
| ***D03D 23/00*** | (2006.01) |
| ***D03D 43/00*** | (2006.01) |

(52) U.S. Cl. ..... 149/62; 149/45; 149/61; 149/109.2; 149/109.4

(58) Field of Classification Search ..... 149/62, 149/45, 61, 109.2, 109.4
See application file for complete search history.

(56) References Cited

U.S. PATENT DOCUMENTS

| | | | | |
|---|---|---|---|---|
| 5,035,757 | A | 7/1991 | Poole | 149/46 |
| 5,139,588 | A | 8/1992 | Poole | 149/61 |
| 5,531,941 | A | 7/1996 | Poole | 264/3.4 |
| 5,756,929 | A | 5/1998 | Lundstrom et al. | 149/22 |
| 6,340,401 | B1 * | 1/2002 | Wheatley et al. | 149/109.6 |
| 6,964,716 | B2 * | 11/2005 | Wu | 149/45 |
| 2004/0108031 | A1 * | 6/2004 | Gast et al. | 149/45 |
| 2005/0257866 | A1 * | 11/2005 | Williams et al. | 149/36 |
| 2005/0263223 | A1 * | 12/2005 | Halpin et al. | 149/19.6 |
| 2007/0175553 | A1 * | 8/2007 | Burns et al. | 149/36 |

OTHER PUBLICATIONS

Office Action U.S Appl. No. 12/384,632, filed Apr. 7, 2009, Mailed Oct. 21, 2011 (196).

* cited by examiner

*Primary Examiner* — James McDonough
(74) *Attorney, Agent, or Firm* — L. C. Begin & Associates, PLLC.

(57) ABSTRACT

A novel auto-ignition/gas generating composition contains a primary fuel selected from salts of azoles, alkyl tetrazoles, and mixtures thereof; a secondary fuel selected from salts of organic acids; and a primary oxidizer selected from metal nitrates. A tertiary fuel may also be provided and is selected from organic acids. Gas generators and gas generating systems incorporating the novel compositions are also contemplated.

6 Claims, 1 Drawing Sheet

GAS GENERANT WITH AUTOIGNITION FUNCTION

CROSS-REFERENCE TO RELATED APPLICATIONS

The present application claims the benefit of U.S. Provisional Application Ser. Nos. 61/132,557 having a filing date of Jun. 18, 2008, and, 61/132,556 having a filing date of Jun. 18, 2008.

BACKGROUND

It is an ongoing challenge to improve thermal stability of pyrotechnic compositions used in airbag or vehicle occupant protection applications. It is an ongoing challenge to combine auto-ignition function and gas generating function (greater than 70 wt % gas product) into one composition. In certain compositions, as thermal stability improves, the auto-ignition of the composition increases to temperatures greater than 200 C. Existing auto-ignition having an auto-ignition temperature of about 160-170 C, but decompose after aging losing up to 10% mass by weight after 400 hours at 107 C. Accordingly, it is desirable to improve thermal stability in accordance with U.S. Car requirements for example, while concurrently reducing the auto-ignition temperature to an auto-ignition temperature equal to or less than 170 C.

Another concern is that certain auto-ignition compositions require that relatively more reactive oxidizers such as potassium chlorate or sodium nitrate be integrated into the composition to meet design requirements. Although useful, care must be taken in handling during processing, and care must also be taken to ensure compliance with sensitivity limits when integrating various constituents into the AI composition.

SUMMARY OF THE INVENTION

The above-referenced concerns are resolved by gas generators or gas generating systems containing novel auto-ignition/gas generating compositions. Compositions in accordance with the present invention include a primary, secondary, and if desired, tertiary fuel. Primary fuels are selected from salts of tetrazoles, alkyl tetrazoles, and mixtures thereof. Secondary fuels are selected from organic nitrate salts. Tertiary fuels are selected from organic acids. A primary oxidizer is selected from metal nitrates and mixtures thereof. A secondary oxidizer may if desired be included, and is selected from metal and nonmetal perchlorates.

In further accordance with the present invention, a gas generator or gas generating system, and a vehicle occupant protection system incorporating the gas generant composition are also included.

DETAILED DESCRIPTION OF THE INVENTION

Figure 1:
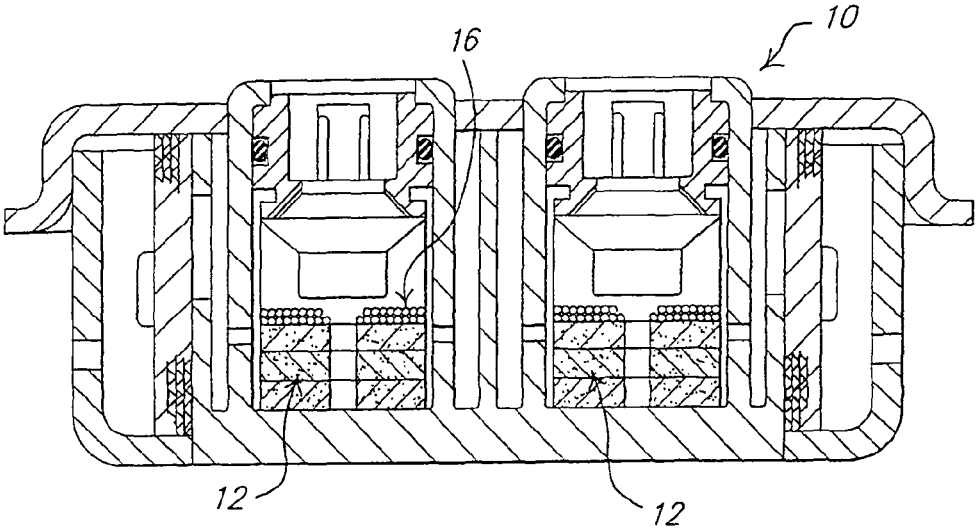
FIG. 1 is a cross-sectional side view showing the general structure of an inflator in accordance with the present invention.

The present compositions resolve the concerns given above, and certain embodiments typically exhibit auto-ignition temperatures of about 147-166 C. As described below, in one embodiment, the auto-ignition/gas generating composition may only contain two fuels. In yet another embodiment, the composition may contain up to three fuels.

The compositions of the present invention contain at least one primary fuel selected from salts of tetrazoles, alkyl tetrazoles, and mixtures thereof.

One group of tetrazole salts are described in U.S. Pat. No. 5,872,329, herein incorporated by reference in its entirety. One exemplary tetrazole salt is salt of bis-tetrazole amine (BTA), and one exemplary salt of BTA is the mono-ammonium salt of bis-tetrazole amine. This may be provided by Toyo Kasei, HyGro, or other chemical suppliers.

More specifically, salts of tetrazoles include in particular, amine, amino, and amide nonmetal salts of tetrazole and triazole selected from the group including monoguanidinium salt of 5,5'-Bis-1H-tetrazole (BHT.1GAD), diguanidinium salt of 5,5'-Bis-1H-tetrazole (BHT.2GAD), monoaminoguanidinium salt of 5,5'-Bis-1H-tetrazole (BHT.1AGAD), diaminoguanidinium salt of 5,5'-Bis-1H-tetrazole (BHT.2AGAD), monohydrazinium salt of 5,5'-Bis-1H-tetrazole (BHT.1HH), dihydrazinium salt of 5,5'-Bis-1H-tetrazole (BHT.2HH), monoammonium salt of 5,5'-bis-1H-tetrazole (BHT.1$NH_3$), diammonium salt of 5,5'-bis-1H-tetrazole (BHT.2$NH_3$), mono-3-amino-1,2,4-triazolium salt of 5,5'-bis-1H-tetrazole (BHT.1ATAZ), di-3-amino-1,2,4-triazolium salt of 5,5'-bis-1H-tetrazole (BHT.2ATAZ), and diguanidinium salt of 5,5'-Azobis-1H-tetrazole (ABHT.2GAD).

Amine salts of triazoles include monoammonium salt of 3-nitro-1,2,4-triazole (NTA.1$NH_3$), monoguanidinium salt of 3-nitro-1,2,4-triazole (NTA.1GAD), diammonium salt of dinitrobitriazole (DNBTR.2$NH_3$), diguanidinium salt of dinitrobitriazole (DNBTR.2GAD), and monoammonium salt of 3,5-dinitro-1,2,4-triazole (DNTR.1$NH_3$).

Formula I

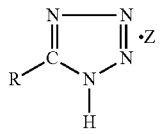

Formula II

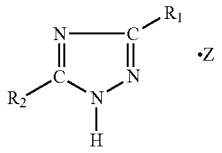

A generic nonmetal salt of tetrazole as shown in Formula I includes a cationic nitrogen containing component, Z, and an anionic component comprising a tetrazole ring and an R group substituted on the 5-position of the tetrazole ring. A generic nonmetal salt of triazole as shown in Formula II includes a cationic nitrogen containing component, Z, and an anionic component comprising a triazole ring and two R groups substituted on the 3- and 5-positions of the triazole ring, wherein $R_1$ may or may not be structurally synonymous with $R_2$. An R component is selected from a group including hydrogen or any nitrogen-containing compound such as an amino, nitro, nitramino, or a tetrazolyl or triazolyl group as shown in Formula I or II, respectively, substituted directly or via amine, diazo, or triazo groups. The compound Z is substituted at the 1-position of either formula, and is formed from a member of the group comprising amines, aminos, and amides including ammonia, carbohydrazide, oxamic hydrazide, and hydrazine; guanidine compounds such as guanidine, aminoguanidine, diaminoguanidine, triaminoguanidine, dicyandiamide and nitroguanidine; nitrogen substituted carbonyl compounds or amides such as urea, oxamide, bis-(carbonamide)amine, azodicarbonamide, and hydrazodicarbonamide; and, amino azoles such as 3-amino-1,2,4-triazole, 3-amino-5-nitro-1,2,4-triazole, 5-aminotetrazole, 3-nitramino-1,2,4-triazole, 5-nitraminotetrazole, and melamine.

Alkyl tetrazoles may be defined as tetrazoles containing alkyl groups wherein the total available proton or H+ density equates to or is greater than +2 based on an ionic charge calculation of the protons that are made available during combustion. An exemplary alkyl tetrazole includes bitetrazole methane. Other alkyl tetrazoles include bitetrazole ethane, bitetrazole propane, and mixtures thereof. More specifically, alkyl tetrazoles also include those described in U.S. Pat. No. 4,142,029, column 1, line 58 through column 2, line 31, herein incorporated by reference. More specifically, an alkyl tetrazole may be chosen from bitetrazoles having an available hydrogen on each tetrazole ring, wherein the bitetrazoles are bridged by a direct bond, or a straight-chain or branched-chain alkylene group which has 1-10 C atoms. In general, U.S. Pat. No. 4,142,029 is herein incorporated by reference as a teaching of the availability or manufacture of these types of compounds.

A secondary fuel is also provided and selected from at least one organic nitrate salt. Organic nitrate salts include amino guanidine nitrate, di-amino guanidine nitrate, tri-amino guanidine nitrate, and mixtures thereof. An exemplary organic nitrate salt is guanidine nitrate.

If only a primary and a secondary fuel are employed, each of these fuels are included in a total fuel component wherein the molar ratio of the two fuels is preferably about (0.75 to 1.25):(0.75 to 1.25). An exemplary ratio is about 1:1, or each fuel represented in the total fuel component is provided at about one mol for each respective mol of the other respective fuel component.

A third or tertiary fuel is also provided and selected from at least one organic acid. Organic acids include dl-tartaric acid, d-tartaric acid, l-tartaric acid, formic acid, mucic acid, fumaric acid, and mixtures thereof. An exemplary organic acid is fumaric acid. It has been found that the third fuel mitigates any potential issues of sensitivity.

When employing a primary, secondary, and tertiary fuel, each of these fuels are included in a total fuel component wherein the molar ratio of the three fuels is preferably about (0.75 to 1.25):(0.75 to 1.25):(0.75 to 1.25). An exemplary ratio is about 1:1:1, or each fuel represented in the total fuel component at about one mol for each respective mol of the other two respective fuel components.

A primary oxidizer is selected from metal nitrates, with strontium nitrate preferred. Metal nitrates include alkali, alkaline earth, and transitional metal nitrates. A secondary oxidizer selected from metal and nonmetal perchlorates may be included with the metal nitrate in a total oxidizer component if desired. Metal perchlorates include alkali metal, alkaline earth metal, and transitional metal perchlorates. Nonmetal perchlorates include ammonium perchlorate. Other known pyrotechnic constituents may be added if desired. In general, either a nitrate salt, or a nitrate salt and a perchlorate salt may be used, but a nitrate salt is preferred. Even further, other known oxidizers may be employed so long as sensitivity requirements are met.

The total fuel component is provided at about 10 to 90 wt. % of the total composition. The total oxidizer component is provided at about 10-90 wt. % of the total composition. The fuel and oxidizer constituents may be ground, mixed, and comminuted in a known manner, by dry and/or wet methods. The resultant homogeneous composition may then be provided in powder form, or pelletized or otherwise formed in known shapes.

The constituents of the present composition, and additives, may be supplied by suppliers known in the art including Aldrich, Fischer, Toyo Kasei, HyGro, and other suppliers. Other known additives such as processing aids are considered useful in the present compositions, and include molybdenum disulfide, silica, graphite, boron nitride, clay, and mixtures thereof. These additional additives may be added at about 0.1 to 15 weight percent of the total composition.

The constituents of the present composition may be wet mixed or dry mixed, as known in the art, to form a homogeneous mixture. Accordingly, the constituents may be comminuted in a planetary mixer for example, and then provided in granulated form, or provided in pelletized or extrusions as desired.

The compositions may be employed in gas generators typically found in airbag devices or occupant protection systems, or in safety belt devices, or in gas generating systems such as a vehicle occupant protection system, all manufactured as known in the art, or as appreciated by one of ordinary skill. Other applications, including military applications, are also contemplated.

As shown in FIG. 1, an exemplary inflator or gas generating system 10 incorporates a dual chamber design to tailor containing a primary gas generating composition 12 formed as described herein, may be manufactured as known in the art. U.S. Pat. Nos. 6,422,601, 6,805,377, 6,659,500, 6,749,219, and 6,752,421 exemplify typical airbag inflator designs and are each incorporated herein by reference in their entirety.

Figure 2:
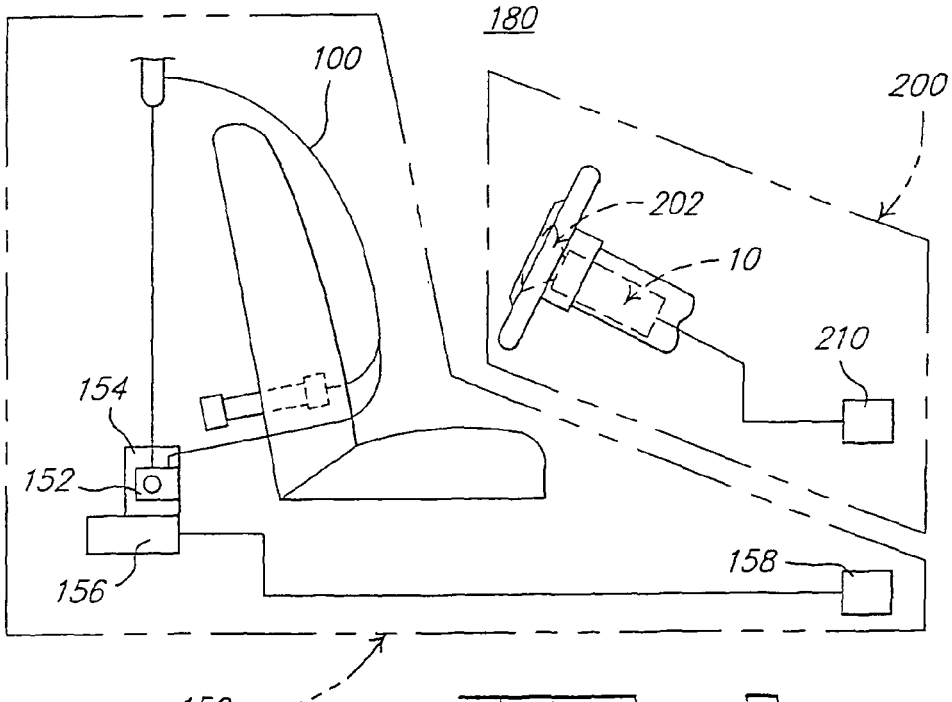
FIG. 2 is a schematic representation of an exemplary vehicle occupant restraint system containing a gas generant composition in accordance with the present invention.

Referring now to FIG. 2, the exemplary inflator or gas generating system 10 described above may also be incorporated into an airbag system 200. Airbag system 200 includes at least one airbag 202 and an inflator 10 containing a gas generant composition 12 in accordance with the present invention, coupled to airbag 202 so as to enable fluid communication with an interior of the airbag. Airbag system 200 may also include (or be in communication with) a crash event sensor 210. Crash event sensor 210 includes a known crash sensor algorithm that signals actuation of airbag system 200 via, for example, activation of airbag inflator 10 in the event of a collision.

Referring again to FIG. 2, airbag system 200 may also be incorporated into a broader, more comprehensive vehicle occupant restraint system 180 including additional elements such as a safety belt assembly 150. FIG. 2 shows a schematic diagram of one exemplary embodiment of such a restraint system. Safety belt assembly 150 includes a safety belt housing 152 and a safety belt 100 extending from housing 152. A safety belt retractor mechanism 154 (for example, a spring-loaded mechanism) may be coupled to an end portion of the belt. In addition, a safety belt pretensioner 156 containing gas generating/auto ignition composition 12 may be coupled to belt retractor mechanism 154 to actuate the retractor mechanism in the event of a collision. Typical seat belt retractor mechanisms which may be used in conjunction with the safety belt embodiments of the present invention are described in U.S. Pat. Nos. 5,743,480, 5,553,803, 5,667,161, 5,451,008, 4,558,832 and 4,597,546, incorporated herein by reference. Illustrative examples of typical pretensioners with which the safety belt embodiments of the present invention may be combined are described in U.S. Pat. Nos. 6,505,790 and 6,419,177, incorporated herein by reference.

Safety belt assembly 150 may also include (or be in communication with) a crash event sensor 158 (for example, an inertia sensor or an accelerometer) including a known crash sensor algorithm that signals actuation of belt pretensioner 156 via, for example, activation of a pyrotechnic igniter (not shown) incorporated into the pretensioner. U.S. Pat. Nos. 6,505,790 and 6,419,177, previously incorporated herein by reference, provide illustrative examples of pretensioners actuated in such a manner.

It should be appreciated that safety belt assembly 150, airbag system 200, and more broadly, vehicle occupant protection system 180 exemplify but do not limit gas generating systems contemplated in accordance with the present invention.

It should further be understood that the preceding is merely a detailed description of various embodiments of this invention and that numerous changes to the disclosed embodiments can be made in accordance with the disclosure herein without departing from the scope of the invention. The preceding description, therefore, is not meant to limit the scope of the invention. Rather, the scope of the invention is to be determined only by the appended claims and their equivalents.

What is claimed is:

1. A composition consisting of:

a primary fuel selected from the group consisting of salts of azoles, alkyl tetrazoles, and mixtures thereof;

a secondary fuel selected from the group consisting of amino guanidine nitrate, di-amino guanidine nitrate, tri-amino guanidine nitrate, and mixtures thereof;

a tertiary fuel selected from at least one organic acid selected from the group consisting of dl-tartaric acid, d-tartaric acid, l-tartaric acid, formic acid, mucic acid, fumaric acid, and mixtures thereof;

an oxidizer selected from metal nitrates, said oxidizer provided at about 10-90 weight percent of the total composition, and said primary, secondary, and tertiary fuels taken together provided at about 10-90 weight percent of the total composition; and an optional additive selected from the group consisting of molybdenum disulfide, silica, graphite, boron nitride, clay, and mixtures thereof.

2. The composition of claim 1 wherein said primary fuel is an alkyl tetrazole selected from the group consisting of bitetrazole methane, bitetrazole ethane, bitetrazole propane, and mixtures thereof.

3. The composition of claim 1 wherein said primary fuel is a salt of bis-tetrazole amine.

4. The composition of claim 1 wherein said primary fuel is the monoammonium salt of bis-tetrazole amine.

5. A composition comprising:

a salt of bis-tetrazole amine;

a secondary fuel selected from the group consisting of amino guanidine nitrate, di-amino guanidine nitrate, tri-amino guanidine nitrate, and mixtures thereof;

a tertiary fuel selected from at least one organic acid; and an oxidizer selected from metal nitrates, said oxidizer provided at about 10-90 weight percent of the total composition, and said primary, secondary, and tertiary fuels taken together provided at about 10-90 weight percent of the total composition.

6. The composition of claim 5 wherein said salt of bis-tetrazole amine is the monoammonium salt of bis-tetrazole amine.

* * * * *